United States Patent [19]

Akamatsu

[11] 3,937,053

[45] Feb. 10, 1976

[54] FORMING DIE STRUCTURE

[76] Inventor: Mototsugu Akamatsu, 2-36 Nishi-Tamiyacho, Hirakata, Osaka, Japan

[22] Filed: Aug. 27, 1974

[21] Appl. No.: 500,955

[52] U.S. Cl. ..... 72/352; 10/24

[51] Int. Cl.[2] ..... B21J 13/02

[58] Field of Search ..... 10/85, 86 F, 24; 76/107 R; 72/352

[56] References Cited

UNITED STATES PATENTS

| | | | |
|---|---|---|---|
| 1,977,163 | 10/1934 | Wilcox | 10/85 |
| 2,044,986 | 6/1936 | Horton | 10/24 |
| 2,202,324 | 5/1940 | Tomalis | 10/24 |
| 2,544,302 | 3/1951 | Duncan | 76/107 R |
| 2,568,440 | 9/1951 | Friedman | 10/85 |
| 2,756,444 | 7/1956 | Schaeffer | 10/85 |
| 3,169,257 | 2/1965 | Loos et al. | 10/86 F |
| 3,191,204 | 6/1965 | McClellan, et al. | 10/24 |
| 3,848,453 | 11/1974 | Hardt | 76/107 R |

*Primary Examiner*—Lowell A. Larson
*Attorney, Agent, or Firm*—Bacon & Thomas

[57] ABSTRACT

A die assembly for forming nuts or the like in which a die cavity is formed to extend into two abutting members of super hard alloy, the cavity extending through one member and having a bottom surface in the other. The hard alloy members rest on a hardened steel stock die and the three elements are shrink fitted in a reinforcement ring. A passageway communicates with the interface between the hard alloy members and extends to a position adjacent but spaced from the interface between those members. When forming pressure is applied to a workpiece in the cavity, the stock die yields resiliently to permit a slight separation between the hard alloy members and thus provide a vent passage for trapped air to the exterior of the assembly. The interface between the die members and the reinforcement ring permits such downward movement of the lower alloy die member but prevents upward ejection of the die members from the reinforcement ring upon operation of a work ejecting mechanism.

6 Claims, 3 Drawing Figures

FORMING DIE STRUCTURE

BACKGROUND OF THE INVENTION

This invention relates to forming dies for forming bolts, nuts and similar machine parts.

Hitherto, in the forming of bolts, nuts and the like, a forming cavity has been formed in two adjacent parts, which parts were shrink-fitted within a reinforcement ring. In such prior devices, the two die parts were formed of super hard alloy and provided with a permanently open air flow hole extending into the die cavity at the interface of the parts. In such dies, however, it was found that the air vent passage was subject to being clogged with scale or oils from the workpiece. If the diameter of the vent hold was made large enough to avoid such clogging, the finished workpiece was found to have "flashes" resulting in an undesirable surface.

Also, such prior devices were customarily supported on a table meant to absorb the impact of the punch at the time of forming a workpiece. Those impacts were transmitted to the supporting table and a violent reaction force occurred in the dies which was found to often cause damage thereto.

It has also been proposed to support such dies on a compressive steel bed plate thereby absorbing impact by the elasticity of the bed plate. (Refer to "Punching Technique Handbook", pp 372; published on June 30, 1962; Publishers: *Nikkan Kogyo Shimbun-sha.* (Daily Industrial Newspaper Company, Ltd.), 1–1, Iida-cho, Chiyoda-ku, Tokyo, Japan).

In the above case, however, when the bed plate was compressed by the punching force of the punch, the following reaction often caused the upper die member to slip upwardly out of the reinforcing ring.

SUMMARY OF THE INVENTION

By the present invention upper and lower die members, jointly defining a die cavity, are supported by a stock die, all of which are shrunk fit into a reinforcing ring and the stock die thus absorbs the impact of the punch by its elastic cushioning action, resulting in a lower reaction force. Preferably, the die members in which the cavity is formed are made from sintered hard alloy material and the stock die is formed of a quenched steel, which is harder than ordinary steel but softer than the sintered alloy of the upper and lower dies. The resiliency of the stock die permits slight downward movement of the lower die member to thus provide a vent passage for trapped air, which could result in an imperfect surface on the finished workpiece and/or damage to the dies themselves. The separation of the upper and lower dies is so minute, however, that metal cannot enter the space therebetween and no "flashes" are formed and scale or other material cannot enter the small space thus produced to result in any clogging.

DESCRIPTION OF A PREFERRED EMBODIMENT

Figure 1:
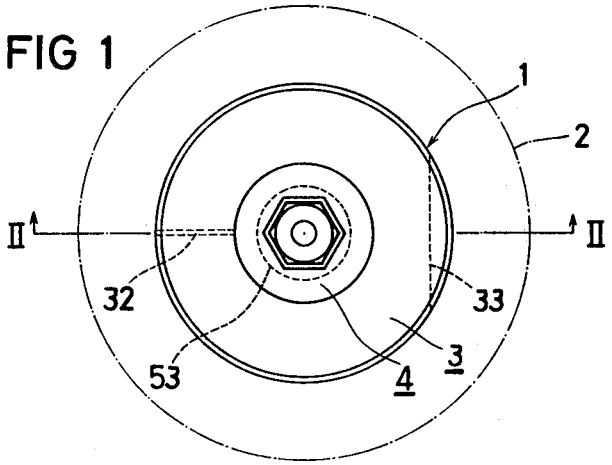
FIG. 1 is a plan view of a die assembly embodying the present invention.

The drawings illustrate an embodiment of this invention particularly directed to a die assembly for the cold forming of nuts. The die assembly 1 consists of a reinforcement ring 3 mounted in a table member 2 of a more or less conventional punching machine. Upper and lower die members 4 and 5 are shrink-fitted in the reinforcement ring 3 in a well known manner, fitting within a bore 31 of the ring 3. As shown, the upper portion of the bore 31 tapers upwardly in the form of a cone surface and the upper portion of that tapered bore receives the upper die member 4 and the lower die member 5 which are formed having outer surfaces complementary to the cone surface described. The lower portion of the bore 31 is of cylindrical form and embraces and holds a stock die 6.

The upper and lower die members 5 are preferably formed of a super hard material such as the well-known sintered hard alloys, for example, tungsten carbide. The upper die member 4 is provided with a portion 41 of a die cavity formed to define a hexagon of the size of the desired nut. The upper surface of the lower die member 5 is provided with the head forming portion 51 of the die cavity which is defined by a depression in die member 5 of the desired shape and it is to be noted that the cavity portion 51 merges with the cavity portion 41 of the upper die member and the die members are in intimate abutment at the interface 54 surrounding the die cavity. As will be apparent, the radial dimensions of the dies are maintained stable during punching by virtue of the shrink fit of reinforcing ring 3 thereabout and downward forces will be resisted by stock die 6, thus straightening the upper and lower dies and reducing the possibility of cracks being developed therein as a result of repeated punching operations.

The stock die 6 is of resiliently compressive material and harder than ordinary steel but softer than the alloy of the upper and lower die members. It thus provides a cushioning action for the upper and lower dies by its elastic deformation under punching impacts.

Figure 2:
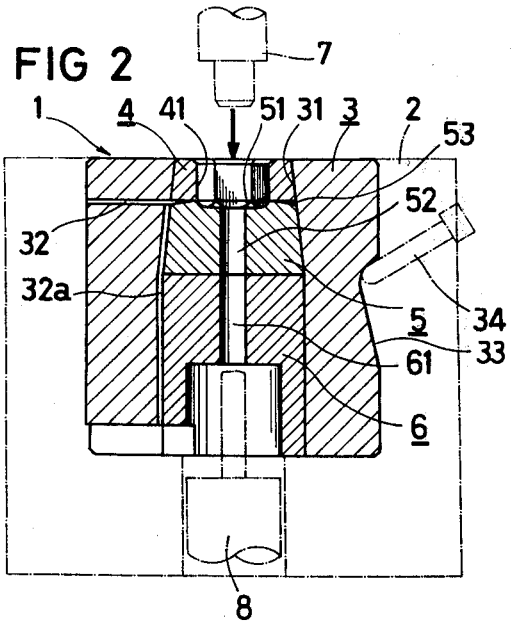
FIG. 2 is a vertical sectional view taken substantially along the line II–II of FIG. 1 with punch and eject members and a holding base shown in dot-dash line.
Figure 3:
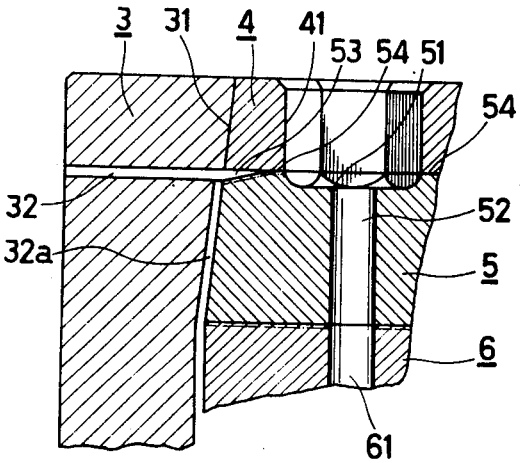
FIG. 3 is an enlarged fragmentary sectional view of the upper portion of FIG. 2.

Extending centrally through the lower die member from the bottom of the forming cavity is a passageway 52 aligned with a central opening 61 through stock die 6. Thus, a passageway is provided for the operation of a work ejecting tool 8 for ejecting the finished nut blank from the forming cavity after a punching operation. As clearly shown in FIGS. 2 and 3, the upper surface of lower die member 5 is formed to an obtuse taper to provide a space 53 between the upper portion of die member 5 and the lower surface of die member 4 extending nearly to the die forming cavity but short thereof so that those portions of the die members 4 and 5 immediately surrounding the die cavity are normally in intimate surface contact at 54 to define a continuous smooth inner surface for the die cavity at their interface. The outer circumferential surface of the reinforcing ring 3 may be provided with a groove or the like defining a channel 32*a* communicating with the space 53. In addition to the passage 32*a* or in lieu thereof, the reinforcing ring 3 may be provided with a further passage 32, also communicating with the sapce 53. Thus, communication is provided between space 53 and the exterior of the die assembly. As shown in FIG. 2, a set screw or holding bolt 34 is provided which holds the die assembly in the table member 2.

Also shown by broken line in FIG. 2 is a conventional pressure punch 7, which is forced downwardly onto a blank in the forming cavity to cause the blank to assume the shape of the cavity. As the punch 7 descends, the downward pressure applied to the upwardly facing surface of the cavity portion 51 is transmitted through die member 5 to stock die 6, which latter being supported by table member 2 will undergo a small amount of resilient compression and thus absorb punching shock and thus improve the operation of the dies. At the same time the intimately contacting interface surfaces of the die members 4 and 5 become slightly separated to provide a vent for any air trapped between the die cavity and the workpiece and permits that air to be vented through space 53 and the described passages.

By virtue of the conical shape of the upper portion of bore 31 and the corresponding peripheral shapes of die members 4 and 5, the upward reaction thereon after cessation of the punching impact by elastic expansion of stock die 6 results in retention of the die members 4 and 5 in the bore 31. In the absence of the conical formation described, the elastic expansion of stock die 6 could eject at least die member 4 from the reinforcing ring 3 and such ejection could also result from the upward pressure of the ejecting tool 8 acting on the formed workpiece in the die cavity.

While a single specific embodiment of the invention has been shown and described herein, the same is merely illustrative of the principles of the invention and other forms may be resorted to within the scope of the appended claims.

I claim:

1. A forming die having an upwardly open die cavity therein, comprising:

an upper die member of hard material having the upper portion of said die cavity extending therethrough;

a lower die member of hard material abutting a lower surface of said upper die member and having the lower portion of said die cavity formed therein, including an upwardly facing bottom surface of said cavity;

a stock die member underlying and abutting said lower die member and being of softer and more resilient material than said upper and lower die members;

an air vent passage extending from the exterior of said die to the interface between said upper and lower die members adjacent but spaced outwardly from said die cavity, said passage opening slightly upon the downward movement of said lower die as said stock die compresses, and said passage immediately closing thereafter whereby metal cannot enter said passage; and a reinforcing ring member tightly surrounding said upper, lower and stock die members and holding the same in said described relationship.

2. A forming die as defined in claim 1 wherein said upper and lower die members are formed of a hard sintered metal alloy.

3. A forming die as defined in claim 1 wherein said stock die is formed of quenched steel.

4. A forming die as defined in claim 1 wherein said upper portion of said die cavity is an opening of hexagonal shape for forming the body portion of a nut and wherein said lower portion of said cavity is a depression in the upper surface of said lower die member, complementary to said upper portion of said cavity and shaped to form the head portion of a nut.

5. A forming die as defined in claim 1 wherein said air vent passage is defined by an annular space between said upper and lower die members, surrounding said cavity but spaced outwardly a short distance therefrom, and a passageway communicating with said annular space and leading therefrom to the exterior of said reinforcing ring member.

6. A forming die as defined in claim 1 including a central opening extending from the bottom of said cavity downwardly through said lower die member and said stock die member, for movement therethrough of a work ejecting tool; the outer peripheries of said upper and lower die members defining a cone surface abutting a complementary cone surface in said reinforcing ring whereby to resist upward displacement of said die members upon operation of said work ejecting tool while permitting downward movement of said lower die member, relative to said upper die member, in response to pressure applied to a workpiece in said cavity whereby to establish limited communication between said die cavity and said air vent passage.

* * * * *